US010626575B2

(12) United States Patent
Kobayashi et al.

(10) Patent No.: US 10,626,575 B2
(45) Date of Patent: Apr. 21, 2020

(54) CONTROL SYSTEM FOR CONSTRUCTION MACHINE

(71) Applicant: Hitachi Construction Machinery Co., Ltd., Taito-ku, Tokyo (JP)

(72) Inventors: Hiroyuki Kobayashi, Tokyo (JP); Hiroshi Sakamoto, Tsuchiura (JP); Yoshiyuki Tsuchie, Tokyo (JP); Hidekazu Moriki, Tokyo (JP); Yasutaka Tsuruga, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 384 days.

(21) Appl. No.: 15/567,723

(22) PCT Filed: Feb. 23, 2016

(86) PCT No.: PCT/JP2016/055252
§ 371 (c)(1),
(2) Date: Oct. 19, 2017

(87) PCT Pub. No.: WO2016/174905
PCT Pub. Date: Nov. 3, 2016

(65) Prior Publication Data

US 2018/0119386 A1 May 3, 2018

(30) Foreign Application Priority Data

Apr. 28, 2015 (JP) ..... 2015-092026

(51) Int. Cl.
*E02F 3/43* (2006.01)
*E02F 9/20* (2006.01)
(Continued)

(52) U.S. Cl.
CPC ..... *E02F 3/43* (2013.01); *E02F 3/32* (2013.01); *E02F 9/2004* (2013.01);
(Continued)

(58) Field of Classification Search
None
See application file for complete search history.

(56) References Cited

U.S. PATENT DOCUMENTS

2005/0210713 A1* 9/2005 Mennen ..... B25J 9/1628 37/195
2016/0202721 A1* 7/2016 Bernardy ..... G06F 3/038 74/471 XY

FOREIGN PATENT DOCUMENTS

JP 11-324026 A 11/1999
JP 2010-248867 A 11/2010
(Continued)

OTHER PUBLICATIONS

International Search Report (PCT/ISA/210) issued in PCT Application No. PCT/JP2016/055252 dated Apr. 26, 2016 with English translation (Three (3) pages).
(Continued)

*Primary Examiner* — Christian Chace
*Assistant Examiner* — Katherine Marie Fitzharris
(74) *Attorney, Agent, or Firm* — Crowell & Moring LLP

(57) ABSTRACT

A control system for a construction machine includes an electric lever operating device that outputs a command to a hydraulic actuator, a travel control lever device that outputs a command to a travel device, and a controller that outputs a drive command to a solenoid proportional valve that decompresses hydraulic fluid supplied from a pilot hydraulic source. The control system includes a machine body state judgment part that judges the state of the machine body based on an electric signal from the electric lever operating device and an operation amount of the travel control lever device and a dead zone calculation part that calculates a dead zone for the electric signal from the electric lever operating device based on the state of the machine body. The dead zone calculation part sets the dead zone for the electric
(Continued)

signal at a first predetermined value when the machine body is in the travel-solo state and sets the dead zone for the electric signal at a second predetermined value smaller than the first predetermined value when the machine body is in the traveling work state.

4 Claims, 13 Drawing Sheets

(51) Int. Cl.
*E02F 9/22* (2006.01)
*E02F 3/32* (2006.01)

(52) U.S. Cl.
CPC ..... *E02F 9/2025* (2013.01); *E02F 9/2037* (2013.01); *E02F 9/22* (2013.01); *E02F 9/2285* (2013.01)

(56) References Cited

FOREIGN PATENT DOCUMENTS

JP 2010248867 A * 11/2010
JP 2013-14981 A 1/2013

OTHER PUBLICATIONS

Japanese-language Written Opinion (PCT/ISA/237) issued in PCT Application No. PCT/JP2016/055252 dated Apr. 26, 2016 (Four (4) pages).
International Preliminary Report on Patentability (PCT/IB/338 & PCT/IB/373) issued in PCT Application No. PCT/JP2016/055252 dated Nov. 9, 2017, including English translation of document C2 (Japanese-language Written Opinion (PCT/ISA/237)) previously dated Oct. 19, 2017 (Six (6) pages).

* cited by examiner

CONTROL SYSTEM FOR CONSTRUCTION MACHINE

TECHNICAL FIELD

The present invention relates to a control system for a construction machine.

BACKGROUND ART

There is a control system for a work machine designed to prevent lever operation malfunction, caused by oscillation of the work machine at times of traveling, with a simple configuration and without impairing lever operability (see Patent Document 1, for example). The control system for a work machine includes a front control lever for operating a front work implement mounted on the work machine, a travel control lever for operating a travel device mounted on the work machine, travel operation amount detection means that detects an input operation amount to the travel control lever, front workload setting means that sets a minimum workload necessary for starting the operation of the front work implement at a higher level compared to cases where the input operation amount is 0 when the input operation amount exceeding 0 is detected by the travel operation amount detection means, and front control means that controls the operation of the front work implement based on magnitude of workload when the workload inputted to the front control lever is higher than or equal to the minimum workload. According to Patent Document 1, a minimum displacement of the front control lever necessary for starting the operation of the front work implement can be changed.

PRIOR ART DOCUMENT

Patent Document

Patent Document 1: JP-2010-248867-A

SUMMARY OF THE INVENTION

Problem to be Solved by the Invention

In the aforementioned control system for a work machine, the width of a neutral dead zone of the front control lever when the travel device is in operation can be increased. Accordingly, the malfunction of the front work implement caused by the machine oscillation can be prevented effectively.

However, the document on the aforementioned control system for a work machine has not referred to cases where the work machine performs work while traveling. Actual work machines have situations in which the work machine performs work while traveling, such as cases where the work machine stuck in marshy ground moves out of the place on one's own ability and cases where the work machine travels while pushing obstacles aside with the front work implement. In such situations, if the dead zone of the operating device is constantly set wide during the traveling, a problem arises in that there are cases where the front work implement does not operate in spite of the operator's intention depending on the lever operation amount and the intended operation becomes impossible.

The object of the present invention, which has been made in consideration of the above-described circumstance, is to provide a control system for a construction machine that handles an electric lever operating device as the front control lever, inhibits the outputting of unnecessary electric lever operating device signals caused by machine body oscillation due to the traveling at times of a travel-solo state of the machine body, and inhibits the output limitation of electric lever operating device signals necessary for work at times of a combined operation such as a combined operation of the traveling and the front operation and a combined operation of the traveling and the swing operation (hereinafter referred to as "traveling work").

Means for Solving the Problem

To resolve the above-described problem, configurations described in claims are employed, for example. While the present application contains multiple means for resolving the above-described problem, an example of the means is as follows:

A control system for a construction machine includes a hydraulic pump, a hydraulic actuator for a front work implement driven by hydraulic fluid delivered from the hydraulic pump, a travel device that allows a machine body to travel, a pilot hydraulic source, a control valve that adjusts a flow rate and a direction of the hydraulic fluid supplied to the hydraulic actuator by controlling pilot pressure, an electric lever operating device that outputs an electric signal for commanding an operating direction and an operating speed of the hydraulic actuator, a travel control lever device for commanding an operating direction and an operating speed of the travel device, a solenoid proportional valve that decompresses the hydraulic fluid supplied from the pilot hydraulic source, and a controller that receives the electric signal from the electric lever operating device and outputs a drive command to the solenoid proportional valve. The controller includes a machine body state judgment part that receives a signal representing an operation amount of the travel control lever device and judges whether the machine body is in a work-solo state, a travel-solo state or a combined traveling-work state based on the electric signal from the electric lever operating device and the operation amount of the travel control lever device, a dead zone calculation part that calculates a dead zone for the electric signal from the electric lever operating device based on the state of the machine body judged by the machine body state judgment part, and a target pilot pressure calculation part that receives a signal representing the dead zone calculated by the dead zone calculation part and the electric signal from the electric lever operating device, calculates a target pilot pressure according to the electric signal and the dead zone, and outputs the drive command to the solenoid proportional valve. The dead zone calculation part sets the dead zone for the electric signal at a first predetermined value when the machine body is in the travel-solo state and sets the dead zone for the electric signal at a second predetermined value smaller than the first predetermined value when the machine body is in the combined traveling-work state.

Effect of the Invention

According to the present invention, it is possible to inhibit the outputting of unnecessary electric lever operating device signals caused by machine body oscillation due to the traveling at times of the travel-solo state of the machine body, and to inhibit the output limitation of electric lever operating device signals necessary for work at times of the combined traveling-work state. Consequently, excellent operability can be secured in any operating scene of the construction machine.

MODES FOR CARRYING OUT THE INVENTION

Embodiments of a control system for a construction machine according to the present invention will be described below with reference to drawings.

First Embodiment

Figure 1:
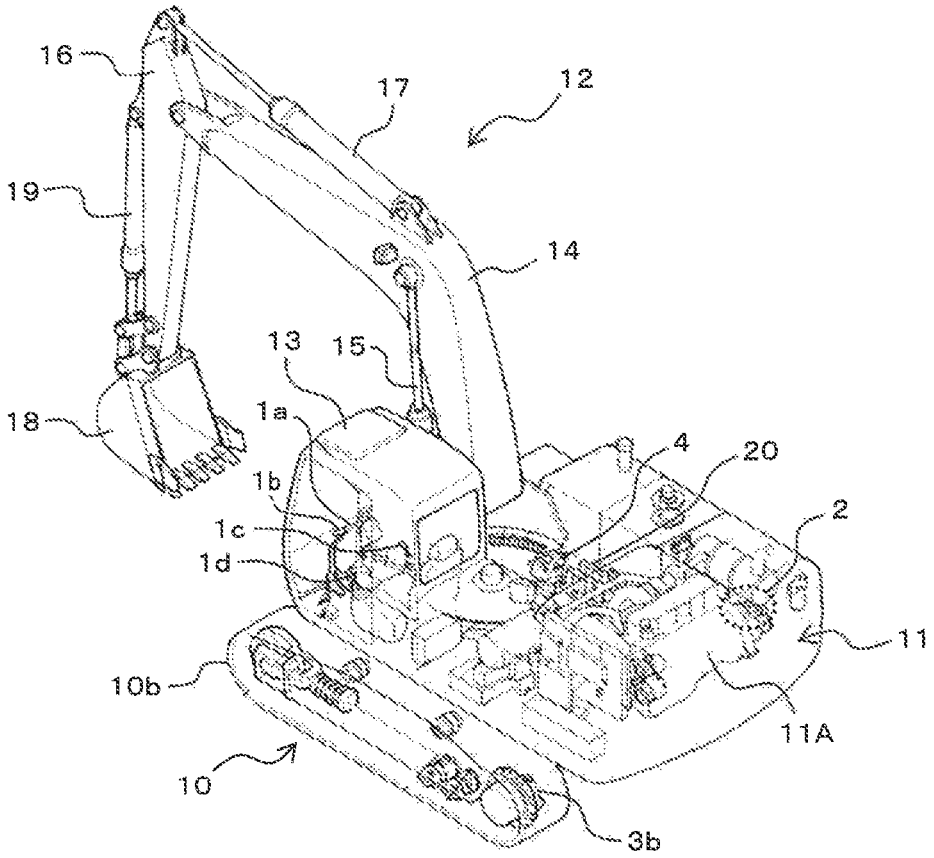
FIG. 1 is a perspective view showing a hydraulic excavator equipped with a first embodiment of a control system for a construction machine according to the present invention.

FIG. 1 is a perspective view showing a hydraulic excavator equipped with a first embodiment of a control system for a construction machine according to the present invention. As shown in FIG. 1, the hydraulic excavator includes a lower track structure 10, an upper swing structure 11 and a front work implement 12. The lower track structure 10 includes left and right crawler-type travel devices 10*b* and 10*a* (only the left-hand side is shown). The left and right crawler-type travel devices 10*b* and 10*a* are driven by left and right travel hydraulic motors 3*b* and 3*a* (only the left-hand side is shown). The upper swing structure 11 is mounted on the lower track structure 10 to be swingable and is driven and swung by a swing hydraulic motor 4. The upper swing structure 11 includes an engine 11A as a prime mover and a hydraulic pump device 2 driven by the engine 11A.

The front work implement 12 is attached to a front part of the upper swing structure 11 to be capable of increasing/decreasing its elevation angle. The upper swing structure 11 is provided with a cab 13. Arranged in the cab 13 are operating devices such as a right travel control lever device 1*a*, a left travel control lever device 1*b*, and right and left control lever devices 1*c* and 1*d* for commanding the operation of the front work implement 12 and the swing operation.

The front work implement 12 is a multijoint structure including a boom 14, an arm 16 and a bucket 18. The boom 14 is rotated in the vertical direction with respect to the upper swing structure 11 by the expansion/contraction of a boom cylinder 15. The arm 16 is rotated in the vertical direction and the longitudinal direction with respect to the boom 14 by the expansion/contraction of an arm cylinder 17. The bucket 18 is rotated in the vertical direction and the longitudinal direction with respect to the arm 16 by the expansion/contraction of a bucket cylinder 19.

The upper swing structure 11 swings with respect to the lower track structure 10 due to the rotation of the swing hydraulic motor 4 by use of hydraulic fluid. The lower track structure 10 travels due to the rotation of the right travel motor 3*a* and the left travel motor 3*b* by use of the hydraulic fluid.

A control valve 20 controls the flow (the flow rate and the direction) of the hydraulic fluid supplied from the hydraulic pump device 2 to each hydraulic actuator such as the aforementioned boom cylinder 15.

Figure 2:
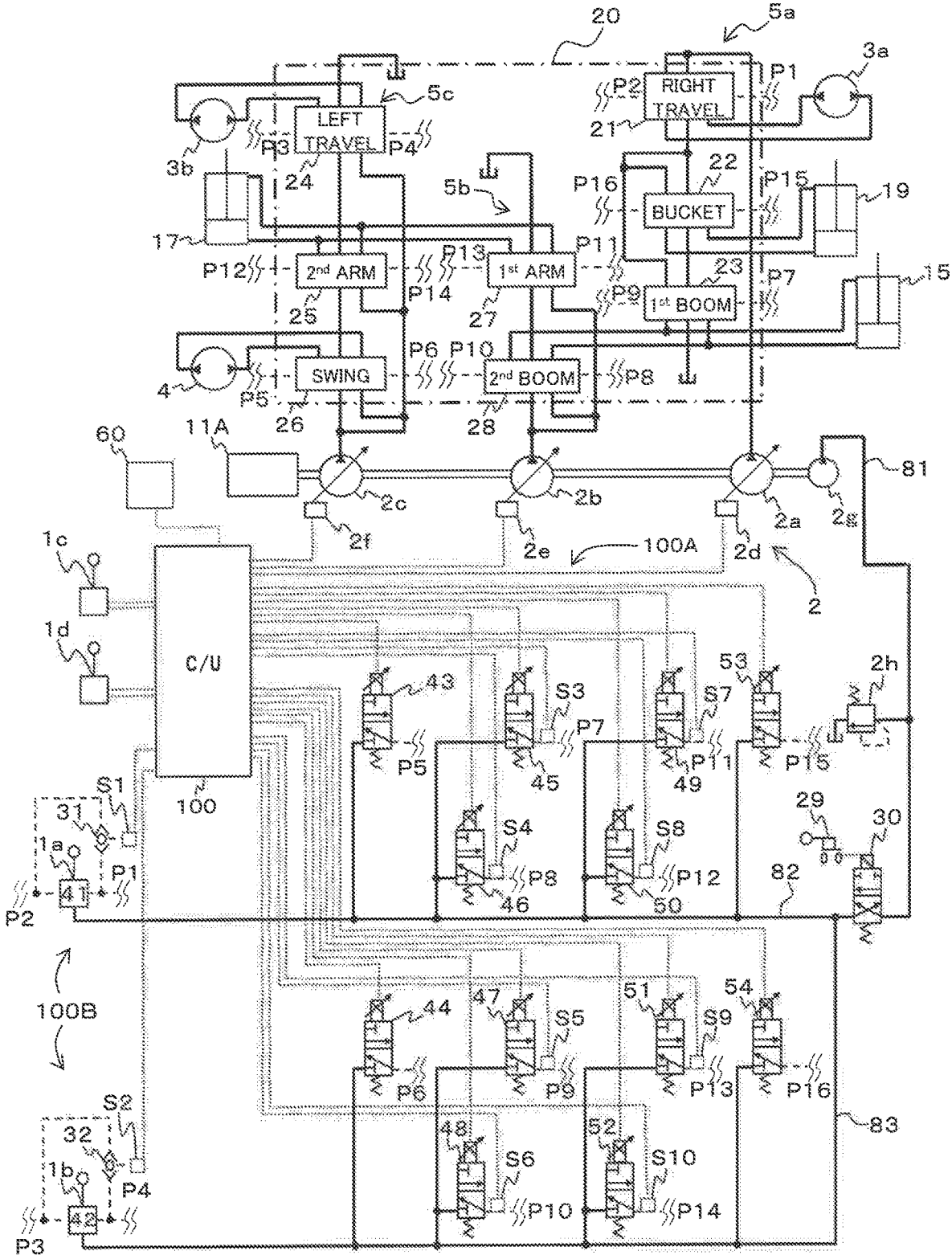
FIG. 2 is a circuit diagram showing a control system for a construction machine equipped with the first embodiment of the control system for a construction machine according to the present invention.

FIG. 2 is a circuit diagram showing a control system for a construction machine equipped with the first embodiment of the control system for a construction machine according to the present invention. To simplify the explanation, illustration and explanation are omitted in regard to a main relief valve, a load check valve, a return circuit, a drain circuit, etc. not directly relevant to the embodiment of the present invention.

As shown in FIG. 2, the control system in this embodiment includes a main hydraulic control circuit including the control valve 20, the hydraulic actuators and the hydraulic pump device 2 and a pilot hydraulic control circuit including a pilot hydraulic pump 2*g*, an electric operating device 100A and a hydraulic operating device 100B.

The control valve 20 of the main hydraulic control circuit includes a right travel direction control valve 21, a bucket direction control valve 22, a first boom direction control valve 23, a left travel direction control valve 24, a second arm direction control valve 25, a swing direction control valve 26, a first arm direction control valve 27 and a second boom direction control valve 28.

All of these direction control valves 21 to 28 are control valves of the center bypass type. The direction control valves 21 to 28 are divided into three valve groups: a first valve group 5*a*, a second valve group 5*b* and a third valve group 5*c*. The first valve group 5*a* includes the right travel direction control valve 21 which is connected only to the right travel motor 3*a*, the bucket direction control valve 22 which is connected only to the bucket cylinder 19, and the first boom direction control valve 23 which is connected only to the boom cylinder 15. The second valve group 5*b* includes the second boom direction control valve 28 which is connected only to the boom cylinder 15 and the first arm direction control valve 27 which is connected only to the arm cylinder 17. The third valve group 5*c* includes the swing direction control valve 26 which is connected only to the swing hydraulic motor 4, the second arm direction control valve 25 which is connected only to the arm cylinder 17, and the left travel direction control valve 24 which is connected only to the left travel hydraulic motor 3*b*.

Each of these direction control valves has an operating part on each end. To the operating parts, pilot lines for supplying pilot hydraulic fluid from the electric operating device or the hydraulic operating device which will be explained later are connected. A spool is switched from the side of the operating part supplied with the pilot hydraulic fluid to the side of the opposite operating part, by which the flow rate and the direction of the hydraulic fluid supplied from the hydraulic pump to the hydraulic actuator are controlled. Specifically, pilot lines P1 and P2 are connected respectively to the operating parts of the right travel direction control valve 21, and pilot lines P3 and P4 are connected respectively to the operating parts of the left travel direction control valve 24.

Further, pilot lines P5 and P6 are connected respectively to the operating parts of the swing direction control valve 26, pilot lines P7 and P9 are connected respectively to the operating parts of the first boom direction control valve 23, and pilot lines P8 and P10 are connected respectively to the operating parts of the second boom direction control valve 28. Furthermore, pilot lines P11 and P13 are connected respectively to the operating parts of the first arm direction control valve 27, pilot lines P12 and P14 are connected respectively to the operating parts of the second arm direction control valve 25, and pilot lines P15 and P16 are connected respectively to the operating parts of the bucket direction control valve 22.

The hydraulic pump device 2 includes the pilot hydraulic pump 2*g* as a fixed displacement pump serving as a pilot hydraulic source and variable displacement pumps driven by the engine 11A. The variable displacement pumps of the hydraulic pump device 2 includes a first hydraulic pump 2*a* for delivering the hydraulic fluid to the first valve group 5*a*, a second hydraulic pump 2*b* for delivering the hydraulic fluid to the second valve group 5*b*, and a third hydraulic pump 2*c* for delivering the hydraulic fluid to the third valve group 5*c*. Incidentally, the first hydraulic pump 2*a* is equipped with a first regulator 2*d*, the second hydraulic pump 2*b* is equipped with a second regulator 2*e*, and the third hydraulic pump 2*c* is equipped with a third regulator 2*f*. Each regulator is capable of changing the displacement of its respective hydraulic pump.

In the first valve group 5*a*, the right travel direction control valve 21 is connected in tandem so as to supply the hydraulic fluid from the first hydraulic pump 2*a* to the right travel motor 3*a* with higher priority than the bucket direction control valve 22 and the first boom direction control valve 23, while the bucket direction control valve 22 and the first boom direction control valve 23 are connected in parallel with each other. In the second valve group 5*b*, the second boom direction control valve 28 and the first arm direction control valve 27 are connected in parallel with each other so as to supply the hydraulic fluid from the second hydraulic pump 2*b* with even priority. In the third valve group 5*c*, the swing direction control valve 26, the second arm direction control valve 25 and the left travel direction control valve 24 are connected in parallel with one another so as to supply the hydraulic fluid from the third hydraulic pump 2*c* with even priority.

The electric operating device 100A of the pilot hydraulic control circuit includes a plurality of solenoid proportional valve 43 to 54, the right and left control lever devices 1*c* and 1*d* as electric lever operating devices, and a controller 100. The hydraulic operating device 100B includes the right and left travel control lever devices 1*a* and 1*b*.

One end of pilot main piping 81 is connected to a delivery port of the pilot hydraulic pump 2*g*, while the other end of the pilot main piping 81 is provided with a gate lock valve 30 as a solenoid control valve that is ON/OFF controlled according to the open/close state of a gate lock lever 29 arranged at the entrance of the cab 13. The pilot main piping 81 is further provided with a relief valve 2*h* for preventing the pressure of the pilot hydraulic fluid from reaching or exceeding a predetermined set pressure. On the downstream side of the gate lock valve 30, pilot first piping 82 and pilot second piping 83 are provided in parallel with each other.

When the operator performs a closing operation on the gate lock lever 29, a switch is closed, an operating part of the gate lock valve 30 is energized, and the gate lock valve 30 is switched to a spool position for setting the pilot main piping 81, the pilot first piping 82 and the pilot second piping 83 in communication with one another. Accordingly, the pilot hydraulic fluid from the pilot hydraulic pump 2*g* is supplied to the pilot first piping 82 and the pilot second piping 83. In contrast, when the operator performs an opening operation on the gate lock lever 29, the switch is opened, the operating part shifts to a non-energized state, and the supply of the pilot hydraulic fluid is stopped.

The pilot first piping 82 is connected to primary ports of a right swing solenoid proportional valve 43, a first boom raising solenoid proportional valve 45, a second boom raising solenoid proportional valve 46, a first arm damping solenoid proportional valve 49, a second arm damping solenoid proportional valve 50 and a bucket damping solenoid proportional valve 53, and to a primary port of a right travel pilot valve 41 provided in the right travel control lever device 1*a*.

The pilot second piping 83 is connected to primary ports of a left swing solenoid proportional valve 44, a first boom lowering solenoid proportional valve 47, a second boom lowering solenoid proportional valve 48, a first arm crowding solenoid proportional valve 51, a second arm crowding solenoid proportional valve 52 and a bucket crowding solenoid proportional valve 54, and to a primary port of a left travel pilot valve 42 provided in the left travel control lever device 1*b*.

The right travel control lever device 1*a* includes the right travel pilot valve 41 mechanically connected to a control lever. According to the operation on the control lever, the right travel pilot valve 41 decompresses a pilot primary pressure supplied from the pilot hydraulic pump 2*g*, thereby generates a pilot secondary pressure, and thereby drives the right travel direction control valve 21. Specifically, when the right travel control lever device 1*a* is operated to a forward travel side, a right forward travel pilot pressure is supplied via the pilot line P1. When the right travel control lever device 1*a* is operated to a backward travel side, a right backward travel pilot pressure is supplied via the pilot line P2.

To hydraulic lines branching from the pilot lines P1 and P2, input ports of a shuttle valve 31 for selecting hydraulic fluid at the higher pressure from these lines are connected. An output port of the shuttle valve 31 is provided with a right travel pressure sensor S1 for detecting the selected maximum pressure. The right travel pressure sensor S1 outputs a right travel pilot pressure signal representing the detected pressure to the controller 100.

Similarly, the left travel control lever device 1*b* includes the left travel pilot valve 42 mechanically connected to a control lever. According to the operation amount and the operation direction of the control lever, the left travel pilot valve 42 generates a pilot secondary pressure and thereby drives the left travel direction control valve 24. When the left travel control lever device 1*b* is operated to the forward travel side, a left forward travel pilot pressure is supplied via the pilot line P3. When the left travel control lever device 1*b* is operated to the backward travel side, a left backward travel pilot pressure is supplied via the pilot line P4.

To hydraulic lines branching from the pilot lines P3 and P4, input ports of a shuttle valve 32 for selecting hydraulic fluid at the higher pressure from these lines are connected. An output port of the shuttle valve 32 is provided with a left travel pressure sensor S2 for detecting the selected maximum pressure. The left travel pressure sensor S2 outputs a left travel pilot pressure signal representing the detected pressure to the controller 100.

The right control lever device 1*c* as an electric lever operating device outputs a boom operation signal and a bucket operation signal to the controller 100 as voltage signals. The left control lever device 1*d* as an electric lever operating device outputs a swing operation signal and an arm operation signal to the controller 100 as voltage signals. Here, each of the right control lever device 1*c* and the left control lever device 1*d* is provided with a widely known displacement sensor, such as a potentiometer or an encoder, for converting the operation amount of the control lever device 1*c*, 1*d* directly into an electric signal. According to the inputted swing operation signal, the controller 100 drives the right swing solenoid proportional valve 43 or the left swing solenoid proportional valve 44 by outputting an electric signal to its solenoid part. Similarly, according to the inputted boom operation signal, the controller 100 drives the first boom raising solenoid proportional valve 45, the second boom raising solenoid proportional valve 46, the first boom lowering solenoid proportional valve 47 or the second boom lowering solenoid proportional valve 48 by outputting an electric signal to its solenoid part. According to the inputted arm operation signal, the controller 100 drives the first arm damping solenoid proportional valve 49, the second arm damping solenoid proportional valve 50, the first arm crowding solenoid proportional valve 51 or the second arm crowding solenoid proportional valve 52 by outputting an electric signal to its solenoid part. According to the inputted bucket operation signal, the controller 100 drives the bucket damping solenoid proportional valve 53 or the bucket crowding solenoid proportional valve 54 by outputting an electric signal to its solenoid part.

By the driving of the right swing solenoid proportional valve 43, a right swing pilot pressure is supplied to a pilot port of the swing direction control valve 26 via the pilot line P5 and drives the swing direction control valve 26. By the driving of the left swing solenoid proportional valve 44, a left swing pilot pressure is supplied to a pilot port of the swing direction control valve 26 via the pilot line P6 and drives the swing direction control valve 26.

By the driving of the first boom raising solenoid proportional valve 45, a first boom raising pilot pressure is supplied to a pilot port of the first boom direction control valve 23 via the pilot line P7 and drives the first boom direction control valve 23. By the driving of the first boom lowering solenoid proportional valve 47, a first boom lowering pilot pressure is supplied to a pilot port of the first boom direction control valve 23 via the pilot line P9 and drives the first boom direction control valve 23. The pilot line P7 is provided with a pressure sensor S3 for detecting the first boom raising pilot pressure. The pilot line P9 is provided with a pressure sensor S5 for detecting the first boom lowering pilot pressure. Each pressure sensor S3, S5 outputs a pilot pressure signal representing the detected pressure to the controller 100.

By the driving of the second boom raising solenoid proportional valve 46, a second boom raising pilot pressure is supplied to a pilot port of the second boom direction control valve 28 via the pilot line P8 and drives the second boom direction control valve 28. By the driving of the second boom lowering solenoid proportional valve 48, a second boom lowering pilot pressure is supplied to a pilot port of the second boom direction control valve 28 via the pilot line P10 and drives the second boom direction control valve 28. The pilot line P8 is provided with a pressure sensor S4 for detecting the second boom raising pilot pressure. The pilot line P10 is provided with a pressure sensor S6 for detecting the second boom lowering pilot pressure. Each pressure sensor S4, S6 outputs a pilot pressure signal representing the detected pressure to the controller 100.

By the driving of the first arm damping solenoid proportional valve 49, a first arm damping pilot pressure is supplied to a pilot port of the first arm direction control valve 27 via the pilot line P11 and drives the first arm direction control valve 27. By the driving of the first arm crowding solenoid proportional valve 51, a first arm crowding pilot pressure is supplied to a pilot port of the first arm direction control valve 27 via the pilot line P13 and drives the first arm direction control valve 27. The pilot line P11 is provided with a pressure sensor S7 for detecting the first arm damping pilot pressure. The pilot line P13 is provided with a pressure sensor S9 for detecting the first arm crowding pilot pressure. Each pressure sensor S7, S9 outputs a pilot pressure signal representing the detected pressure to the controller 100.

By the driving of the second arm damping solenoid proportional valve 50, a second arm damping pilot pressure is supplied to a pilot port of the second arm direction control valve 25 via the pilot line P12 and drives the second arm direction control valve 25. By the driving of the second arm crowding solenoid proportional valve 52, a second arm crowding pilot pressure is supplied to a pilot port of the second arm direction control valve 25 via the pilot line P14 and drives the second arm direction control valve 25. The pilot line P12 is provided with a pressure sensor S8 for detecting the second arm damping pilot pressure. The pilot line P14 is provided with a pressure sensor S10 for detecting the second arm crowding pilot pressure. Each pressure sensor S8, S10 outputs a pilot pressure signal representing the detected pressure to the controller 100.

By the driving of the bucket damping solenoid proportional valve 53, a bucket damping pilot pressure is supplied to a pilot port of the bucket direction control valve 22 via the pilot line P15 and drives the bucket direction control valve 22. By the driving of the bucket crowding solenoid proportional valve 54, a bucket crowding pilot pressure is supplied to a pilot port of the bucket direction control valve 22 via the pilot line P16 and drives the bucket direction control valve 22.

Incidentally, the controller 100 also has a function of figuring out an abnormal state of each solenoid proportional valve based on the inputted pilot pressures and operation signals. A display device 60 is connected to the controller 100. The display device 60 notifies the operator of information on the abnormal state of each solenoid proportional valve outputted from the controller 100.

Figure 3:
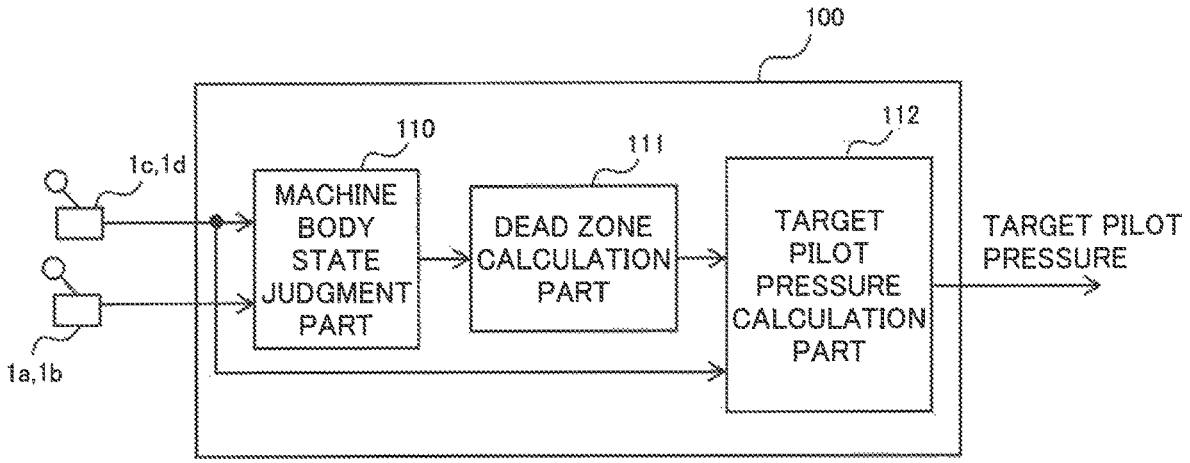
FIG. 3 is a conceptual diagram showing the configuration of a controller included in the first embodiment of the control system for a construction machine according to the present invention.
Figure 4:
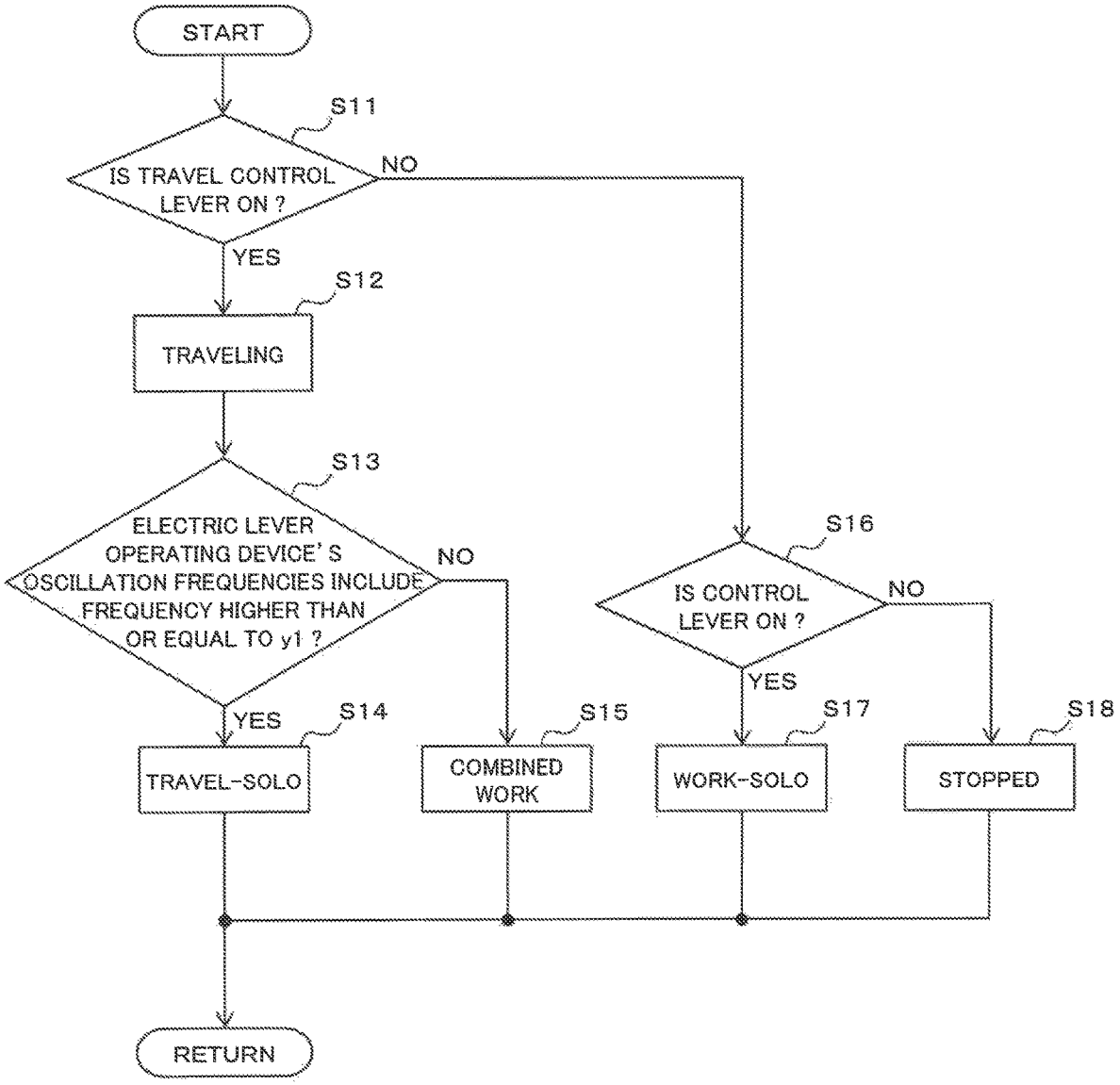
FIG. 4 is a flow chart showing details of processing by a machine body state judgment part included in the first embodiment of the control system for a construction machine according to the present invention.

Next, the controller included in the first embodiment of the control system for a construction machine according to the present invention will be explained with reference to drawings. FIG. 3 is a conceptual diagram showing the configuration of the controller included in the first embodiment of the control system for a construction machine according to the present invention. FIG. 4 is a flow chart showing details of processing by a machine body state judgment part included in the first embodiment of the control system for a construction machine according to the present invention.

As shown in FIG. 3, the controller 100 includes a machine body state judgment part 110 that judges the state of the machine body, a dead zone calculation part 111 that determines a dead zone of the electric lever operating devices according to the state of the machine body, and a target pilot pressure calculation part 112 that sets a target pilot pressure.

The machine body state judgment part 110 receives output signals from the right travel control lever device 1*a*, the left travel control lever device 1*b*, the right control lever device 1*c* and the left control lever device 1*d* and judges whether these signals represent a travel-solo operation, a work-solo operation by the front work implement, or a combined traveling-work operation. Then, the machine body state judgment part 110 outputs a command signal for the judged machine body (hereinafter referred to as a "state signal") to the dead zone calculation part 111.

The dead zone calculation part 111 receives the state signal of the machine body as the result of the judgment by the machine body state judgment part 110 and determines the dead zone for the signals from the electric lever operating devices for driving the hydraulic actuators based on the machine body state signal. The dead zone calculation part 111 outputs a dead zone signal representing the determined dead zone to the target pilot pressure calculation part 112.

The target pilot pressure calculation part 112 receives the output signals from the right control lever device 1*c* and the left control lever device 1*d* and the dead zone signal from the dead zone calculation part 111, calculates a target pilot pressure in regard to final lever operation amounts for the swing direction control valve 26, the boom direction control valves 23 and 28, the arm direction control valves 25 and 27, and the bucket direction control valve 22, and outputs command signals to pertinent solenoid proportional valves so as to achieve the calculated target pilot pressure.

A judgment method for the machine body state judgment part 110 will be described below with reference to FIG. 4. The machine body state judgment part 110 judges whether or not a travel control lever device is ON (step S11). Specifically, it is judged that a travel control lever device is ON when the operation signal from the right travel control lever device 1*a* or the left travel control lever device 1*b* is higher than or equal to a preset threshold value. The process advances to step S12 when a travel control lever device is ON, or to step S16 otherwise.

When a travel control lever device is judged to be ON in the step S11, the machine body state judgment part 110 judges that the machine body is in a traveling state (step S12).

The machine body state judgment part 110 measures oscillation frequencies of the operation signal from each electric lever operating device (hereinafter referred to as "electric lever operating device's oscillation frequencies") and judges whether or not the electric lever operating device's oscillation frequencies include a frequency component higher than or equal to a predetermined frequency that has been set previously (hereinafter referred to as a "predetermined value y1") (step S13). Here, the predetermined value y1 is a threshold value for discriminating between frequencies caused by operations by the operator and frequencies caused by machine body oscillation. The predetermined value y1 is set at a high frequency that cannot be reproduced by the operator's lever operation. The process advances to step S14 when the electric lever operating device's oscillation frequencies are judged to include a frequency higher than or equal to the predetermined value y1, or to step S15 otherwise.

When the electric lever operating device's oscillation frequencies are judged to include a frequency component higher than or equal to the predetermined value y1 in the step S13, the machine body state judgment part 110 judges that the machine body is in a travel-solo state (step S14). When the electric lever operating device's oscillation frequencies are judged not to include a frequency component higher than or equal to the predetermined value y1 in the step S13, the machine body state judgment part 110 judges that the machine body is in a combined traveling-work state (step S15).

When it is judged that no travel control lever device is ON in the step S11, the machine body state judgment part 110 judges whether or not an electric lever operating device is ON (step S16). Specifically, it is judged that an electric lever operating device is ON when the operation signal from the right control lever device 1*c* or the left control lever device 1*d* is higher than or equal to a preset threshold value. The process advances to step S17 when an electric lever operating device is ON, or to step S18 otherwise.

When an electric lever operating device is judged to be ON in the step S16, the machine body state judgment part 110 judges that the machine body is in a work-solo state (step S17). When no electric lever operating device is judged to be ON in the step S16, the machine body state judgment part 110 judges that the machine body is in a stopped state (step S18).

After completing the processing of the step S14, the step S15, the step S17 or the step S18, the machine body state judgment part 110 performs a return process.

Figure 6:
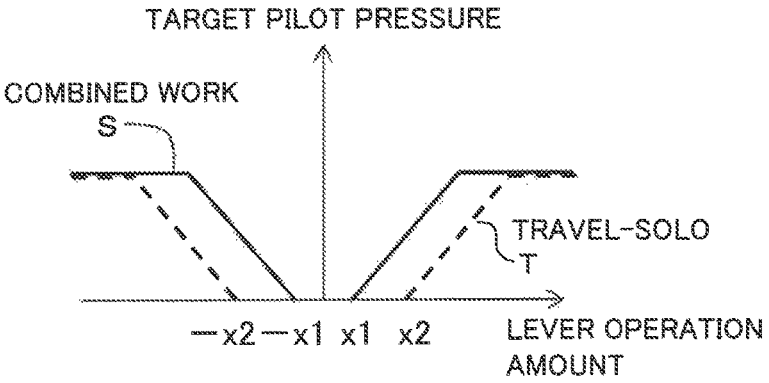
FIG. 6 is a characteristic diagram showing the relationship between a lever operation amount and a target pilot pressure controlled by a target pilot pressure calculation part included in the first embodiment of the control system for a construction machine according to the present invention.
Figure 5:
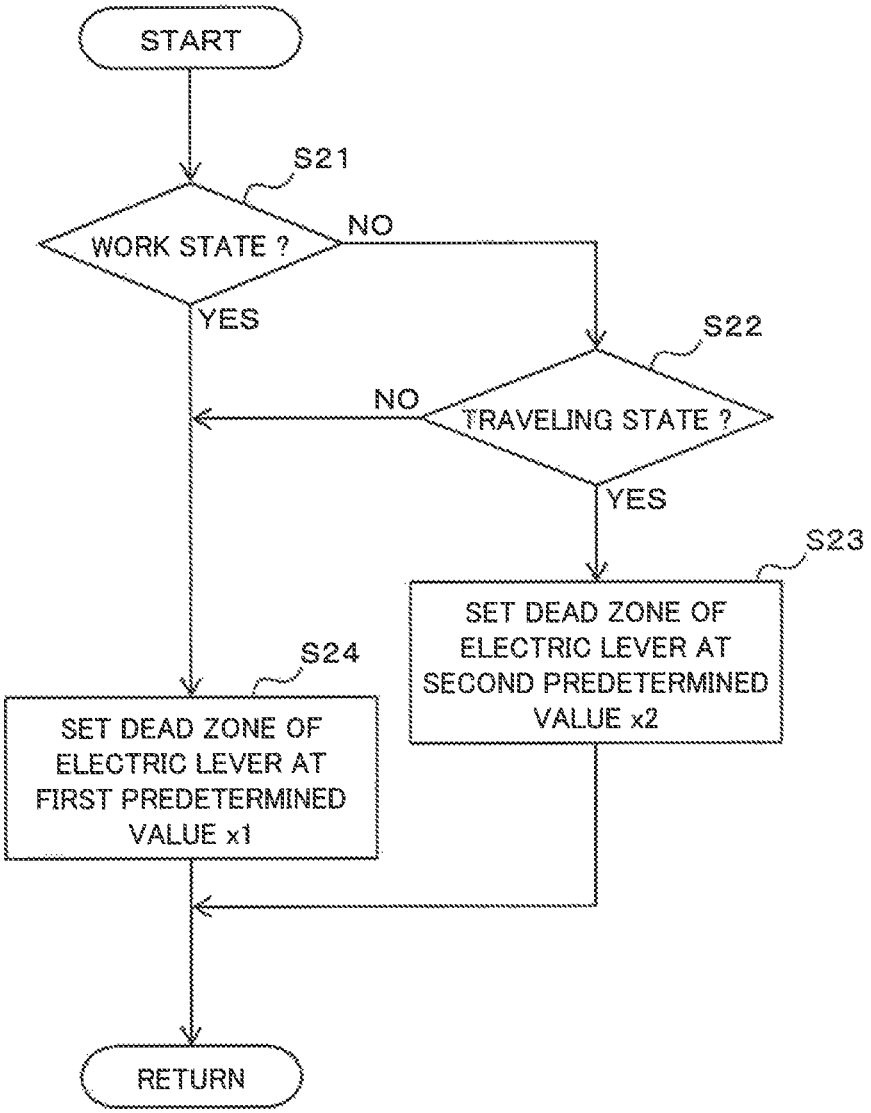
FIG. 5 is a flow chart showing details of processing by a dead zone calculation part included in the first embodiment of the control system for a construction machine according to the present invention.

Next, details of the processing by the dead zone calculation part 111 and the target pilot pressure calculation part 112 will be described below with reference to FIG. 5 and FIG. 6. FIG. 5 is a flow chart showing the details of the processing by the dead zone calculation part included in the first embodiment of the control system for a construction machine according to the present invention. FIG. 6 is a characteristic diagram showing the relationship between the lever operation amount and the target pilot pressure controlled by the target pilot pressure calculation part included in the first embodiment of the control system for a construction machine according to the present invention. In FIG. 6, the horizontal axis represents the lever operation amount of an electric lever operating device and the vertical axis represents the target pilot pressure outputted by the target pilot pressure calculation part 112. The characteristic line S indicated by the solid line represents the target pilot pressure with respect to the lever operation amount at times of the combined traveling-work state. The characteristic line T indicated by the broken line represents the target pilot pressure with respect to the lever operation amount at times of the travel-solo state. In FIG. 6, according to the characteristic line S, no target pilot pressure is outputted when the lever operation amount is lower than x1 or higher than −x1. When the lever operation amount is higher than or equal to x1 or lower than or equal to −x1, the target pilot pressure gradually increases depending on the lever operation amount. Similarly, according to the characteristic line T, no target pilot pressure is outputted when the lever operation amount is lower than x2 or higher than −x2. When the lever operation amount is higher than or equal to x2 or lower than or equal to −x2, the target pilot pressure gradually increases depending on the lever operation amount. Here, x1 and x2 are predetermined values determined by the dead zone calculation part 11.

In FIG. 5, the dead zone calculation part 111 judges whether or not the machine body is in a work state (the work-solo state by the front work implement 12 or the combined traveling-work state (step S21). Specifically, the judgment is made based on the signal from the machine body state judgment part 110. The process advances to step S24 when the machine body is in the work state, or to step S22 otherwise.

In the step S22, the dead zone calculation part 111 judges whether or not the machine body is in the traveling state (travel-solo state). Specifically, the judgment is made based on the signal from the machine body state judgment part 110. The process advances to step S23 when the machine body is in the traveling state, or to the step S24 otherwise.

When the machine body is judged to be in the traveling state in the step S22, the dead zone calculation part 111 sets the dead zone for the operation signal from the electric lever operating device at the second predetermined value x2 (step S23). Specifically, at times of the travel-solo state, a wide dead zone is set so as to realize the characteristic line T shown in FIG. 6. When the lever operation amount is between −x2 and x2, no target pilot pressure is outputted. When the lever operation amount is higher than or equal to x2 or lower than or equal to −x2, the target pilot pressure is gradually increased depending on the lever operation amount.

When the machine body is judged to be in the work state in the step S21 or judged not to be in the traveling state in the step S22, the dead zone calculation part 111 sets the dead zone for the operation signal from the electric lever operating device at the first predetermined value x1 (step S24). Specifically, at times of the traveling work or work, a narrow dead zone is set so as to realize the characteristic line S shown in FIG. 6. When the lever operation amount is between −x1 and x1, no target pilot pressure is outputted. When the lever operation amount is higher than or equal to x1 or lower than or equal to −x1, the target pilot pressure is gradually increased depending on the lever operation amount.

After completing the processing of the step S23 or the step S24, the dead zone calculation part 111 performs a return process.

Figure 7:
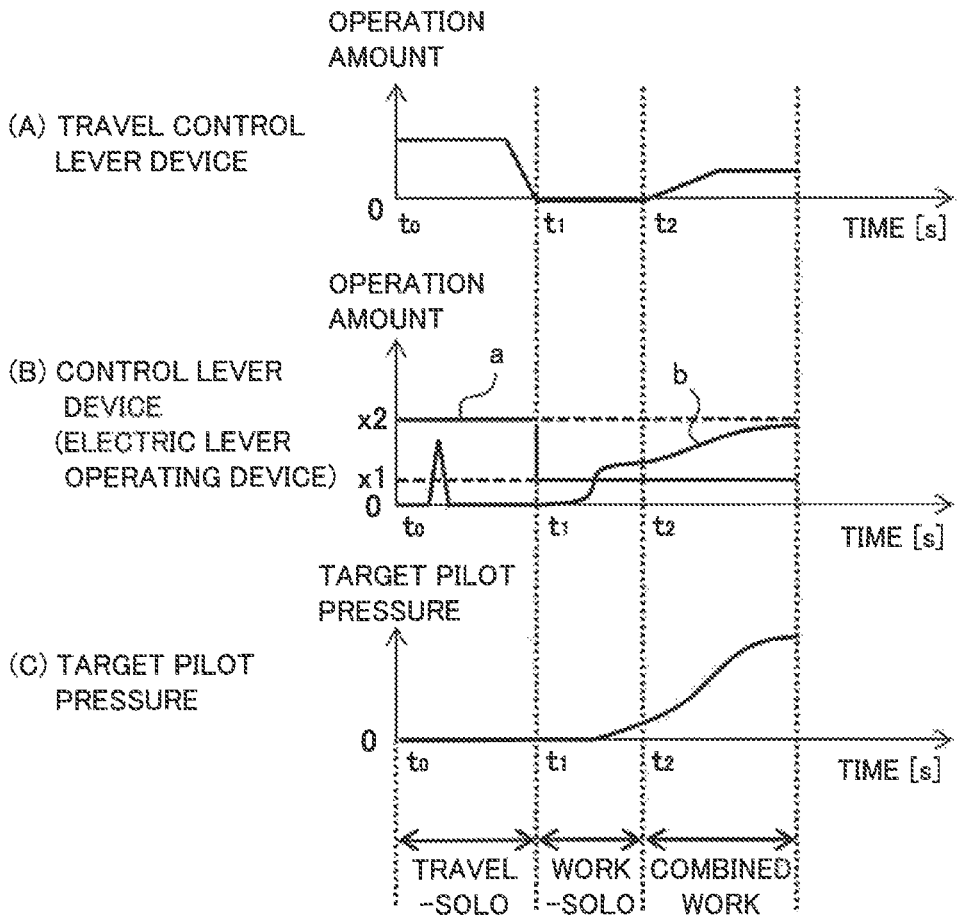
FIG. 7 is a characteristic diagram showing timeline behavior of the operation amount of each operating device and the target pilot pressure in the first embodiment of the control system for a construction machine according to the present invention.

Next, the operation in the first embodiment of the control system for a construction machine according to the present invention will be described below with reference to FIG. 7. FIG. 7 is a characteristic diagram showing timeline behavior of the operation amount of each operating device and the target pilot pressure in the first embodiment of the control system for a construction machine according to the present invention. In FIG. 7, the horizontal axis represents time. The vertical axis in FIG. 7(A) represents the operation amount signal of a travel control lever device, the vertical axis in FIG. 7(B) represents the operation amount signal of an electric lever operating device, and the vertical axis in FIG. 7(C) represents the target pilot pressure signal. In FIG. 7(B), the characteristic line "a" represents the dead zone that has been set, and the line segment "b" represents the operation amount signal from the electric lever operating device. From time $t_0$ to time $t_1$, the machine is in the travel-solo state. From time $t_1$ to time $t_2$, the machine is in the work-solo state. After time $t_2$, the machine is in the state of the traveling work.

Between time $t_0$ and time $t_1$, the machine body state judgment part 110 judges that the machine is in the traveling state. Based on the signal from the machine body state judgment part 110, the dead zone calculation part 111 sets the dead zone for the operation signal from the electric lever operating device at the second predetermined value x2.

As shown in FIG. 7(B), from time $t_0$ to time $t_1$, the line segment "b" as the operation amount signal of the electric lever operating device exhibits mountain-shaped behavior with a peak value over the predetermined value x1 and less than the predetermined value x2. This indicates an operation amount signal caused by oscillation of the machine body. In this case, no command signal is outputted from the target pilot pressure calculation part 112 since the dead zone has been set at the second predetermined value x2 as mentioned above. Accordingly, the target pilot pressure signal remains at zero as shown in FIG. 7(C).

From time $t_1$ to time $t_2$, the machine body state judgment part 110 judges that the machine is in the work state of the front work implement 12. Based on the signal from the machine body state judgment part 110, the dead zone calculation part 111 sets the dead zone for the operation signal from the electric lever operating device at the first predetermined value x1.

As shown in FIG. 7(B), from time $t_1$ to time $t_2$, the line segment "b" as the operation amount signal of the electric lever operating device exhibits behavior of increasing from zero to a value over the predetermined value x1 and less than the predetermined value x2 with a low oscillation frequency. This indicates an operation amount signal caused by the operator's operation. In this case, since the dead zone has been set at the first predetermined value x1 as mentioned above, the command signal from the target pilot pressure calculation part 112 is outputted from the time when the operation amount signal of the electric lever operating device exceeds x1, and the target pilot pressure signal gradually increases from zero as shown in FIG. 7(C).

After time $t_2$, the machine body state judgment part 110 judges that the machine is in the work state. Based on the signal from the machine body state judgment part 110, the dead zone calculation part 111 sets the dead zone for the operation signal from the electric lever operating device at the first predetermined value x1. As shown in FIG. 7(B), after time $t_2$, the line segment "b" as the operation amount signal of the electric lever operating device exhibits behavior of gradually increasing from a value over the predetermined value x1 to a value in the vicinity of the predetermined value x2 with a low oscillation frequency. This indicates an operation amount signal caused by the operator's operation. In this case, since the dead zone has been set at the first predetermined value x1 as mentioned above, the operation amount signal of the electric lever operating device at the time $t_2$ increases continuously, and the command signal according to the operation amount signal is outputted from the target pilot pressure calculation part 112. Accordingly, the target pilot pressure signal increases continuously from the pressure at the time $t_2$ as shown in FIG. 7(C).

According to this embodiment, by employing the configuration described above, the output limitation of the signal of each electric lever operating device at times of the combined traveling-work state can be inhibited.

By the above-described first embodiment of the control system for a construction machine according to the present invention, it is possible to inhibit the outputting of unnecessary electric lever signals caused by machine body oscillation due to the traveling at times of the travel-solo state of the machine body, and to inhibit the output limitation of the electric lever signals necessary for work at times of the combined traveling-work state and at times of the work-solo state by the front work implement 12. Consequently, excellent operability can be secured in any operating scene of the construction machine.

Second Embodiment

Figure 8:
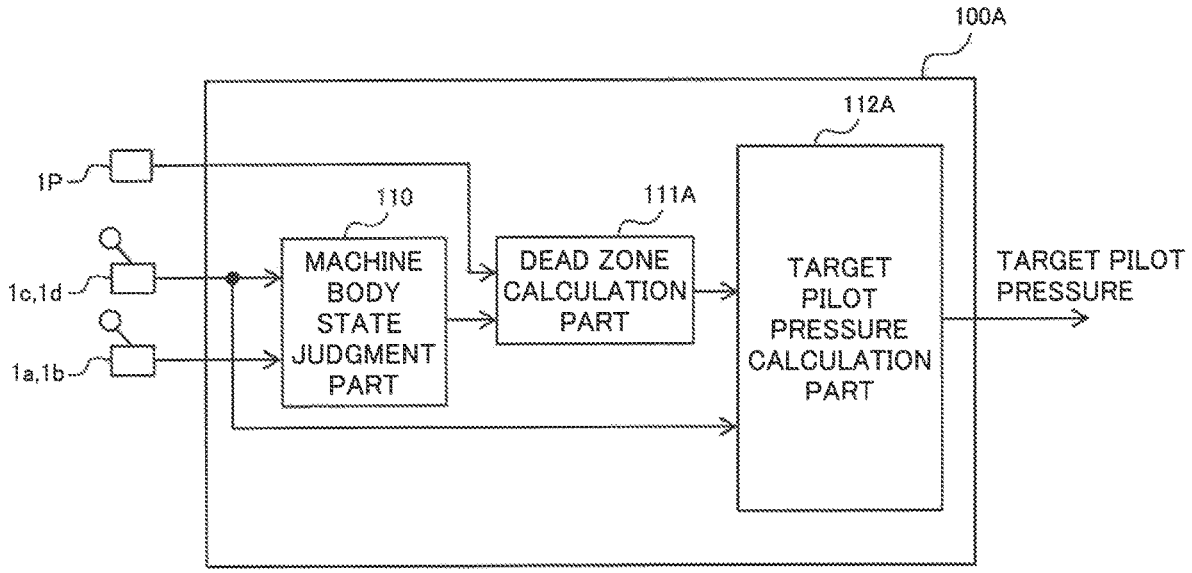
FIG. 8 is a conceptual diagram showing the configuration of a controller included in a second embodiment of the control system for a construction machine according to the present invention.
Figure 9:
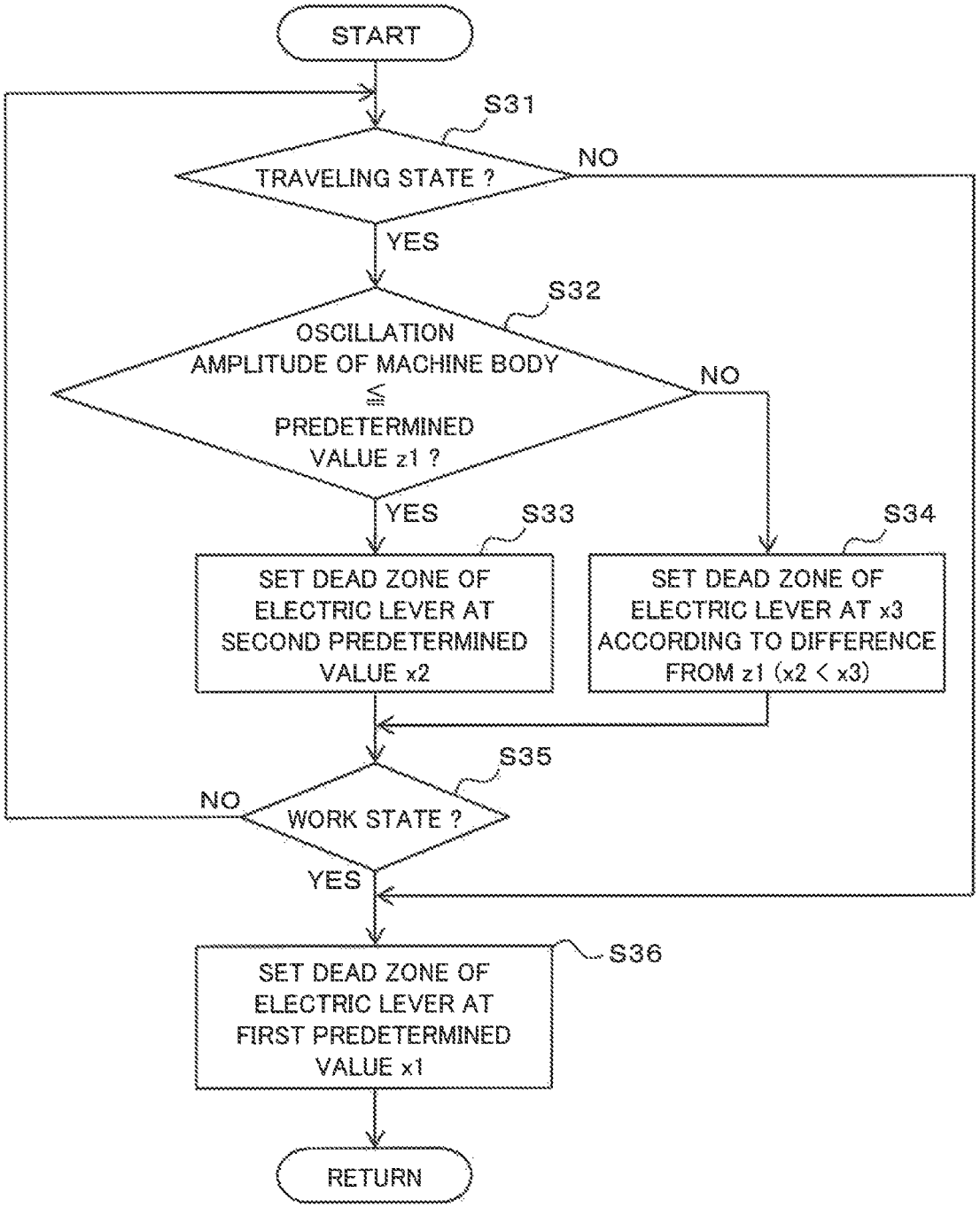
FIG. 9 is a flow chart showing details of processing by a dead zone calculation part included in the second embodiment of the control system for a construction machine according to the present invention.
Figure 10:
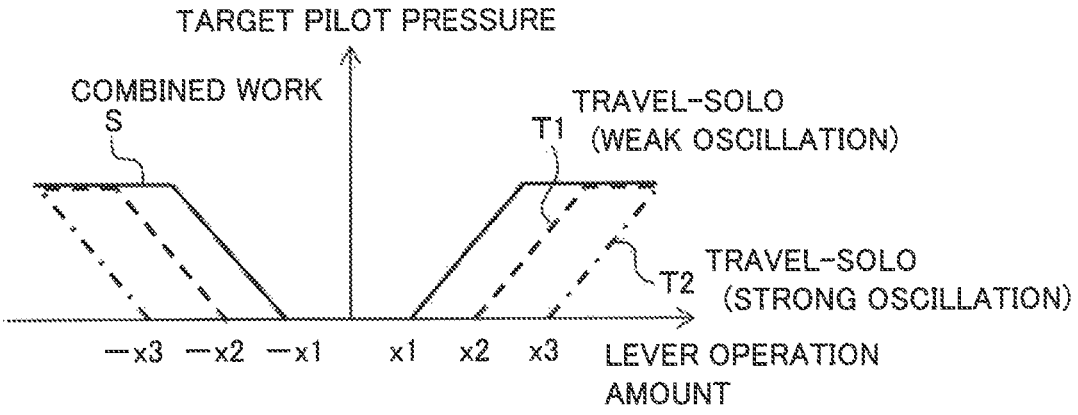
FIG. 10 is a characteristic diagram showing the relationship between the lever operation amount and the target pilot pressure controlled by a target pilot pressure calculation part included in the second embodiment of the control system for a construction machine according to the present invention.
Figure 11:
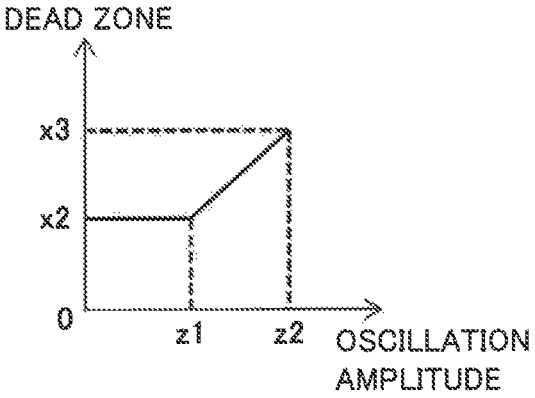
FIG. 11 is a characteristic diagram showing the relationship between machine body oscillation amplitude and the dead zone controlled by the dead zone calculation part included in the second embodiment of the control system for a construction machine according to the present invention.

A second embodiment of the control system for a construction machine according to the present invention will be described below with reference to drawings. FIG. 8 is a conceptual diagram showing the configuration of a controller included in the second embodiment of the control system for a construction machine according to the present invention. FIG. 9 is a flow chart showing details of processing by a dead zone calculation part included in the second embodiment of the control system for a construction machine according to the present invention. FIG. 10 is a characteristic diagram showing the relationship between the lever operation amount and the target pilot pressure controlled by a target pilot pressure calculation part included in the second embodiment of the control system for a construction machine according to the present invention. FIG. 11 is a characteristic diagram showing the relationship between machine body oscillation amplitude and the dead zone controlled by the dead zone calculation part included in the second embodiment of the control system for a construction machine according to the present invention. Elements in FIGS. 8 to 11 indicated with the same reference characters as in FIGS. 1 to 7 are elements identical with those in FIGS. 1 to 7, and thus detailed explanation thereof is omitted for brevity.

In the second embodiment of the control system for a construction machine according to the present invention, the overall configuration of the system is roughly identical with that in the first embodiment but differs in that an acceleration sensor 1P for detecting acceleration occurring to the machine body is provided and a signal representing the acceleration detected by the acceleration sensor 1P is inputted to a controller 100A. As shown in FIG. 8, the machine body state judgment part 110 judges whether the machine body is in the travel-solo state, the work-solo state by the front work implement 12, the combined traveling-work state, or the stopped state, and outputs the result of the judgment to a dead zone calculation part 111A similarly to the operation explained in the first embodiment. The dead zone calculation part 111A receives the signal from the machine body state judgment part 110 and the signal from the acceleration sensor 1P and performs a calculation process that will be explained later. A target pilot pressure calculation part 112A receives a signal from the dead zone calculation part 111A and the signals from the electric lever operating devices 1*c* and 1*d*, determines the target pilot pressure of the direction control valves 22, 23 and 25 to 28, and outputs drive signals to the solenoid proportional valves 45 to 54. In this embodiment, the use of the signal from the acceleration sensor 1P makes it possible to detect the oscillation frequencies and amplitude occurring to the machine body at times of traveling and at times of work and to change the dead zone according to the oscillation frequencies and amplitude varying depending on undulations and inclination of the road surface.

Next, details of the processing by the dead zone calculation part 111 will be described below. In FIG. 10, the horizontal axis represents the lever operation amount of an electric lever operating device and the vertical axis represents the target pilot pressure outputted by the target pilot pressure calculation part 112A. The characteristic line S indicated by the solid line represents the target pilot pressure with respect to the lever operation amount at times of the work-solo state by the front work implement 12 and at times of the combined traveling-work state. The characteristic line T1 indicated by the broken line represents the target pilot pressure with respect to the lever operation amount at times of the travel-solo state with weak machine body oscillation. The characteristic line T2 indicated by the chain line represents the target pilot pressure with respect to the lever operation amount at times of the travel-solo state with strong machine body oscillation. In this configuration, although the characteristic S at times of the work-solo state by the front work implement 12 and at times of the combined traveling-work state is the same as that in the first embodiment, the dead zone at times of the travel-solo state is variable according to the magnitude of the oscillation amplitude of the machine body occurring at times of traveling. In FIG. 10, according to the characteristic line T1, no target pilot pressure is outputted when the lever operation amount is between −x2 and x2. When the lever operation amount is higher than or equal to x2 or lower than or equal to −x2, the target pilot pressure is gradually increased depending on the lever operation amount. According to the characteristic line T2, no target pilot pressure is outputted when the lever operation amount is between −x3 and x3. When the lever operation amount is higher than or equal to x3 or lower than or equal to −x3, the target pilot pressure is gradually increased depending on the lever operation amount. Here, x1, x2 and x3 are predetermined values determined by the dead zone calculation part 111A. Incidentally, x3 is calculated according to the oscillation amplitude of the machine body.

In FIG. 9, the dead zone calculation part 111A judges whether or not the machine body is in the traveling state (step S31). Specifically, the judgment is made based on the signal from the machine body state judgment part 110. The process advances to step S32 when the machine body is in the traveling state, or to step S36 otherwise.

The dead zone calculation part 111A judges whether or not the oscillation amplitude of the machine body in a preset frequency range is lower than or equal to a predetermined value z1 that has been set previously (step S32). Specifically, the oscillation amplitude in the preset frequency range is calculated from the signal representing the acceleration of the machine body detected by the acceleration sensor, and the calculated oscillation amplitude is compared with the predetermined value z1. The process advances to step S33 when the oscillation amplitude of the machine body is lower than or equal to the predetermined value z1, or to step S34 otherwise.

When the oscillation amplitude of the machine body is judged to be lower than or equal to the predetermined value z1 in the step S32, the dead zone calculation part 111A sets the dead zone for the operation signal from the electric lever operating device at the second predetermined value x2 (step S33). Specifically, at times of the travel-solo state with weak machine body oscillation, a dead zone wider than x1 is set so as to realize the characteristic line T1 shown in FIG. 10. When the lever operation amount is between −x2 and x2, no target pilot pressure is outputted. When the lever operation amount is higher than or equal to x2 or lower than or equal to −x2, the target pilot pressure is gradually increased depending on the lever operation amount.

Returning to FIG. 9, when the oscillation amplitude of the machine body is judged not to be lower than or equal to the predetermined value z1 in the step S32, the dead zone calculation part 111A sets the dead zone for the operation signal from the electric lever operating device at the third predetermined value x3 that is calculated according to the actual oscillation amplitude of the machine body (step S34). When the oscillation amplitude of the machine body exceeds z1, the dead zone is set to be wider proportionally to the magnitude of the difference between the oscillation amplitude and z1. Specifically, as shown in FIG. 11, the increment of the new dead zone is calculated by calculating the difference between the actual oscillation amplitude z2 of the machine body and the predetermined value z1 and multiplying the difference by a preset ratio. The third predetermined value x3 is calculated by adding the increment to x2.

Consequently, the characteristic line T2 shown in FIG. 10 is set. Accordingly, at times of the travel-solo state with strong machine body oscillation, a dead zone wider than x2 is set. When the lever operation amount is between −x3 and x3, no target pilot pressure is outputted. When the lever operation amount is higher than or equal to x3 or lower than or equal to −x3, the target pilot pressure is gradually increased depending on the lever operation amount.

Returning to FIG. 9, after the processing of the step S33 or the step S34, the dead zone calculation part 111A advances to step S35 and judges whether or not the machine body is in the work state (step S35). Specifically, the judgment is made based on the signal from the machine body state judgment part 110. The process advances to the step S36 when the machine body is in the work state, or returns to the step S31 otherwise.

When the machine body is judged to be in the work state in the step S35, the dead zone calculation part 111A sets the dead zone for the operation signal from the electric lever operating device at the first predetermined value x1 (step S24). Specifically, at times of the combined traveling-work state or the work-solo state by the front work implement 12, a narrow dead zone is set so as to realize the characteristic line S shown in FIG. 10. When the lever operation amount is between −x1 and x1, no target pilot pressure is outputted. When the lever operation amount is higher than or equal to x1 or lower than or equal to −x1, the target pilot pressure is gradually increased depending on the lever operation amount.

After completing the processing of the step S36, the dead zone calculation part 111A performs a return process.

Figure 12:
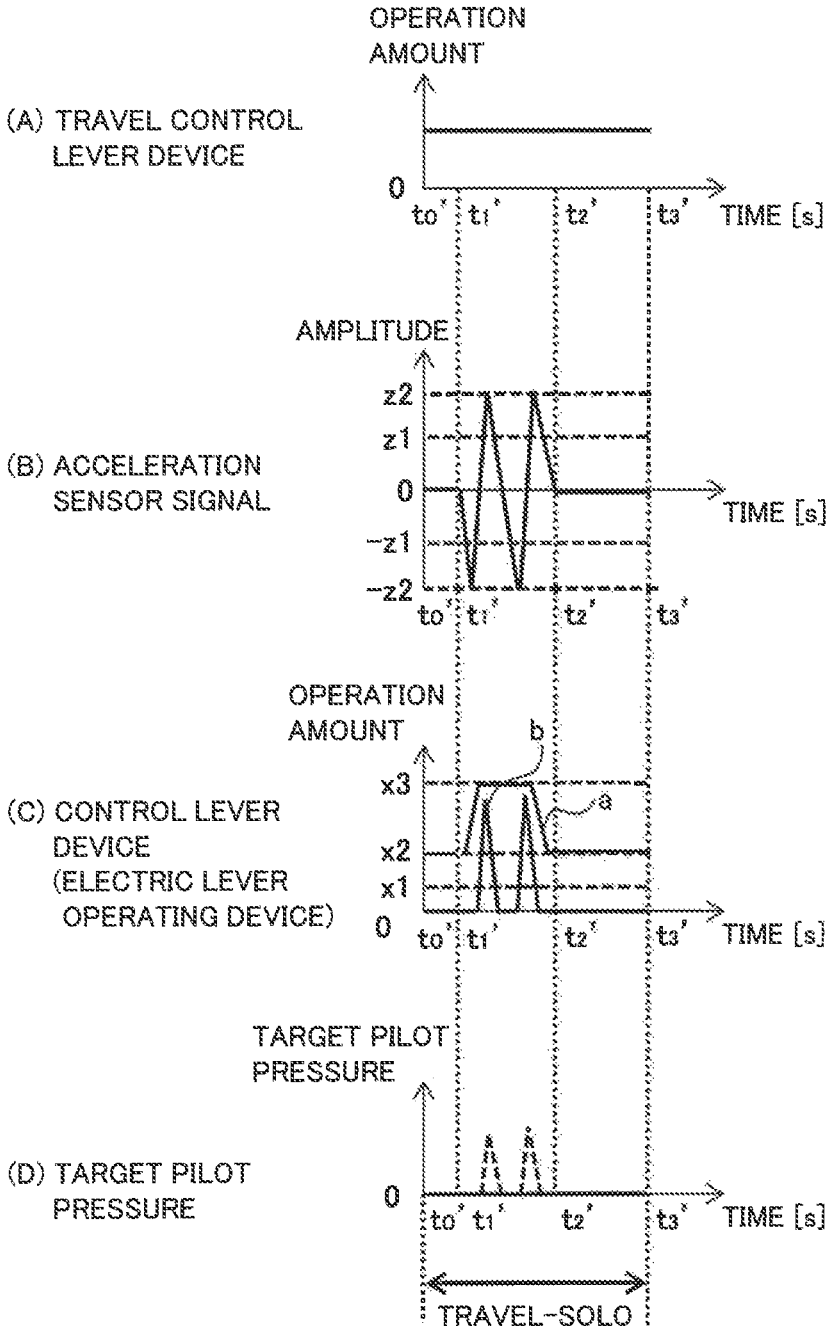
FIG. 12 is a characteristic diagram showing timeline behavior of the operation amount of each operating device, an acceleration sensor signal and the target pilot pressure in the second embodiment of the control system for a construction machine according to the present invention.

Next, the operation in the second embodiment of the control system for a construction machine according to the present invention will be described below with reference to FIG. 12. FIG. 12 is a characteristic diagram showing time-line behavior of the operation amount of each operating device, the acceleration sensor signal and the target pilot pressure in the second embodiment of the control system for a construction machine according to the present invention. In FIG. 12, the horizontal axis represents time. The vertical axis in FIG. 12(A) represents the operation amount signal of a travel control lever device, the vertical axis in FIG. 12(B) represents the machine body amplitude signal based on the acceleration sensor signal, the vertical axis in FIG. 12(C) represents the operation amount signal of an electric lever operating device, and the vertical axis in FIG. 12(D) represents the target pilot pressure signal. In FIG. 12(C), the characteristic line "a" represents the dead zone that has been set, and the line segment "b" represents the operation amount signal from the control lever device. The broken line in FIG. 12(D) represents the target pilot pressure assumed in the first embodiment not equipped with the acceleration sensor.

Between time $t_0'$ and time $t_3'$, the machine is in the travel-solo state in which the operation amount signal of the travel control lever device is constant as shown in FIG. 12(A). Between time $t_1'$ and time $t_2'$, the machine is in a state in which the machine body amplitude based on the acceleration sensor signal shown in FIG. 12(B) fluctuates significantly. Before time $t_1'$ and after time $t_2'$, the amplitude of the machine body is substantially 0.

Between time $t_0'$ and time $t_1'$, the machine body state judgment part 110 judges that the machine is in the travel-solo state. Based on the signal from the machine body state judgment part 110 and the fact that the machine body amplitude based on the acceleration sensor signal shown in FIG. 12(B) is substantially 0 (lower than or equal to the predetermined value z1), the dead zone calculation part 111A sets the dead zone for the operation signal from the electric lever operating device at the second predetermined value x2.

Between time $t_1'$ and time $t_2'$, as shown in FIG. 12(B), the machine body amplitude based on the acceleration sensor signal repeats twice a cycle of changing from 0 to −z2 via −z1, changing from −z2 to z2 via 0 and z1, and returning to 0. Due to this behavior, the line segment "b" in FIG. 12(C) as the operation amount signal of the electric lever operating device exhibits two mountain-shaped behaviors with peak values over the predetermined value x2 and less than the predetermined value x3. This indicates an operation amount signal caused by oscillation of the machine body.

In this case, based on the fact that the machine is in the travel-solo state and the machine body amplitude based on the acceleration sensor signal is over the predetermined value z1, the dead zone calculation part 111A sets the dead zone for the operation signal from the electric lever operating device at the third predetermined value x3 that is calculated according to the actual oscillation amplitude of the machine body. In the operation amount signal of the electric lever operating device shown in FIG. 12(C), the characteristic line "a" represents the predetermined value x3 of the dead zone characteristic that has been set. In this case, no command signal is outputted from the target pilot pressure calculation part 112A since the dead zone has been set at the third predetermined value x3 as mentioned above. Accordingly, the target pilot pressure signal remains at zero as shown in FIG. 12(D).

In the first embodiment not equipped with such a dead zone variable mechanism using the oscillation amplitude of the machine body, when machine body oscillation amplitude higher than or equal to z1 occurs, the operation amount signal of the electric lever operating device shown in FIG. 12(C) exceeds the predetermined value x2, and thus there is a danger that the target pilot pressure rises as indicated by the broken line in FIG. 12(D) and the hydraulic actuators malfunction. In this embodiment, amplitude components caused by the machine body oscillation is detected by the acceleration sensor and the dead zone threshold value of the electric lever operating device is raised to x3, and thus the rise of the target pilot pressure can be prevented and the malfunction of the hydraulic actuators can be prevented.

According to this embodiment, by employing the configuration described above, malfunction of the electric lever operating device due to machine body oscillation occurring at times of the travel-solo operation can be prevented reliably and the output limitation of the signal of the electric lever operating device at times of the combined traveling-work state can be inhibited.

By the above-described second embodiment of the control system for a construction machine according to the present invention, effects similar to the aforementioned effects of the first embodiment can be obtained.

Further, by the above-described second embodiment of the control system for a construction machine according to the present invention, malfunction of the electric lever operating device due to machine body oscillation occurring at times of the travel-solo operation can be prevented reliably.

Third Embodiment

Figure 13:
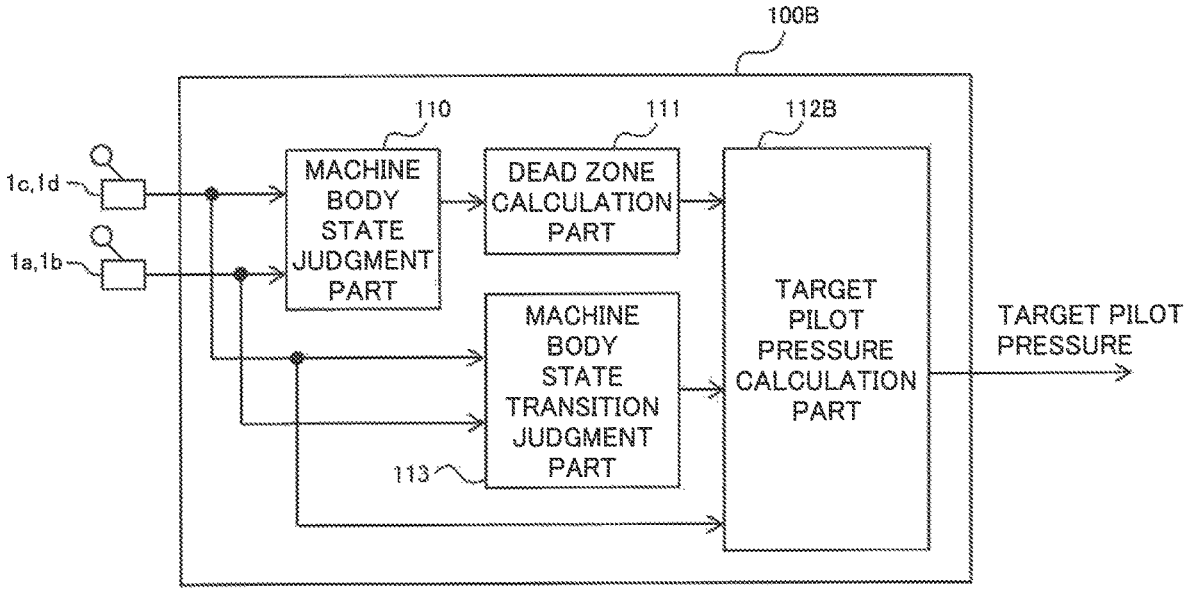
FIG. 13 is a conceptual diagram showing the configuration of a controller included in a third embodiment of the control system for a construction machine according to the present invention.
Figure 14:
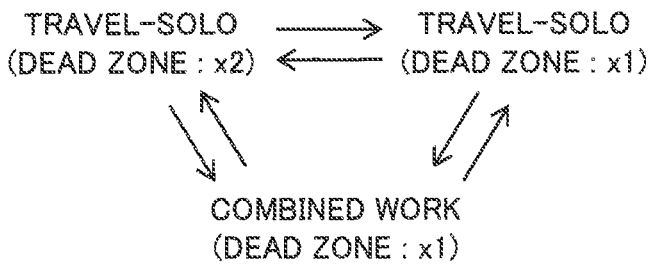
FIG. 14 is a schematic diagram showing state transitions of the machine body in the third embodiment of the control system for a construction machine according to the present invention.
Figure 15:
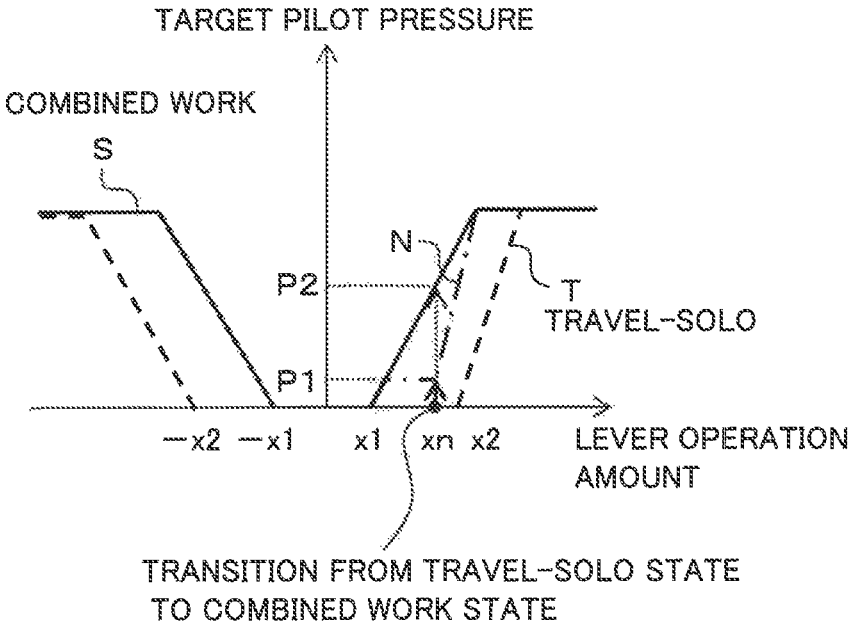
FIG. 15 is a characteristic diagram showing the relationship between the lever operation amount and the target pilot pressure controlled by a target pilot pressure calculation part included in the third embodiment of the control system for a construction machine according to the present invention.

A third embodiment of the control system for a construction machine according to the present invention will be described below with reference to drawings. FIG. 13 is a conceptual diagram showing the configuration of a controller included in the third embodiment of the control system for a construction machine according to the present invention. FIG. 14 is a schematic diagram showing state transitions of the machine body in the third embodiment of the control system for a construction machine according to the present invention. FIG. 15 is a characteristic diagram showing the relationship between the lever operation amount and the target pilot pressure controlled by a target pilot pressure calculation part included in the third embodiment of the control system for a construction machine according to the present invention. Elements in FIGS. 13 to 15 indicated with the same reference characters as in FIGS. 1 to 12 are elements identical with those in FIGS. 1 to 12, and thus detailed explanation thereof is omitted for brevity.

In the third embodiment of the control system for a construction machine according to the present invention, the overall configuration of the system is roughly identical with that in the first embodiment but differs in that a controller 100B further includes a machine body state transition judgment part 113. Specifically, as shown in FIG. 13, the machine body state transition judgment part 113 receives the output signals from the right travel control lever device 1*a*, the left travel control lever device 1*b*, the right control lever device 1*c* and the left control lever device 1*d*, judges state transition of the machine body (transition from which mode (travel-solo, work-solo, or combined traveling-work) to which mode has occurred) based on the signals, and outputs a signal representing the judgment to a target pilot pressure calculation part 112B.

The target pilot pressure calculation part 112B receives the output signals from the right control lever device 1*c* and the left control lever device 1*d*, the signal of the machine body state transition from the machine body state transition judgment part 113, and the dead zone signal from the dead zone calculation part 111, calculates a target pilot pressure in regard to final lever operation amounts, and outputs command signals to pertinent solenoid proportional valves so as to achieve the calculated target pilot pressure.

In this embodiment, a sharp change in the target pilot pressure due to a change in the dead zone is inhibited by the target pilot pressure calculation part 112B in cases of transition from the travel-solo state to the combined traveling-work state and in cases of transition from the combined traveling-work state to the travel-solo state.

The state transitions of the machine body will be explained below with reference to FIG. 14. It is assumed here that the dead zone is set at the same values as in the first embodiment.

In the transition from the travel-solo state to the work-solo state, stoppage of the machine body occurs during the transition, and thus the operator rarely has a feeling of strangeness even if the dead zone changes from x2 to x1. In the transition from the work-solo state to the combined traveling-work state, the operator does not have the feeling of strangeness since the dead zone does not change from x1.

In the transition from the travel-solo state to the combined traveling-work state and in the transition from the combined traveling-work state to the travel-solo state, the operator can have the feeling of strangeness since the dead zone changes without the stoppage of the machine body. For example, when an electric lever operating device is oscillating due to the machine body oscillation in the travel-solo state, the hydraulic actuators do not operate since the dead zone has been set at x2; however, the electric lever operating device can have deviated from its neutral position since the electric lever operating device is oscillating.

In such a situation, if the operator starts operating the electric lever operating device for work, there is a possibility that the work is started from a state in which the electric lever operating device is apart from the neutral position. In such cases, the mode shifts from the travel-solo state to the work-solo state due to the start of the work, and thus the dead zone also decreases from x2 to x1. As a result, there are cases where the target pilot pressure rises, a hydraulic actuator suddenly starts operating, and the operator has the feeling of strangeness.

In this embodiment, such a rise of the target pilot pressure is prevented by the control by the machine body state transition judgment part 113 and the target pilot pressure calculation part 112B as mentioned above. In FIG. 15, the horizontal axis represents the lever operation amount of the electric lever operating device and the vertical axis represents the target pilot pressure outputted by the target pilot pressure calculation part 112B. The characteristic line S indicated by the solid line represents the target pilot pressure with respect to the lever operation amount at times of the work-solo state by the front work implement 12 and at times of the combined traveling-work state. The characteristic line T indicated by the broken line represents the target pilot pressure with respect to the lever operation amount at times of the travel-solo state. The characteristic line N indicated by the chain line represents the target pilot pressure with respect to the lever operation amount that is limited for a predetermined time since the transition from the travel-solo state to the combined traveling-work state.

In FIG. 15, first, when the lever operation amount xn is within a range x1<xn<x2 in the travel-solo state, the target pilot pressure calculation part 112B limits and controls the target pilot pressure with respect to the lever operation amount like the characteristic line N so that the target pilot pressure is set at P1, lower than the target pilot pressure P2 determined without considering the state transition (characteristic line S), for the predetermined time since the state transition from the travel-solo state to the combined traveling-work state. Incidentally, the predetermined time since the state transition, for which the target pilot pressure with respect to the lever operation amount is limited and controlled, may be set longer with the increase in the oscillation or amplitude of the electric lever operating device at times of traveling.

Figure 16:
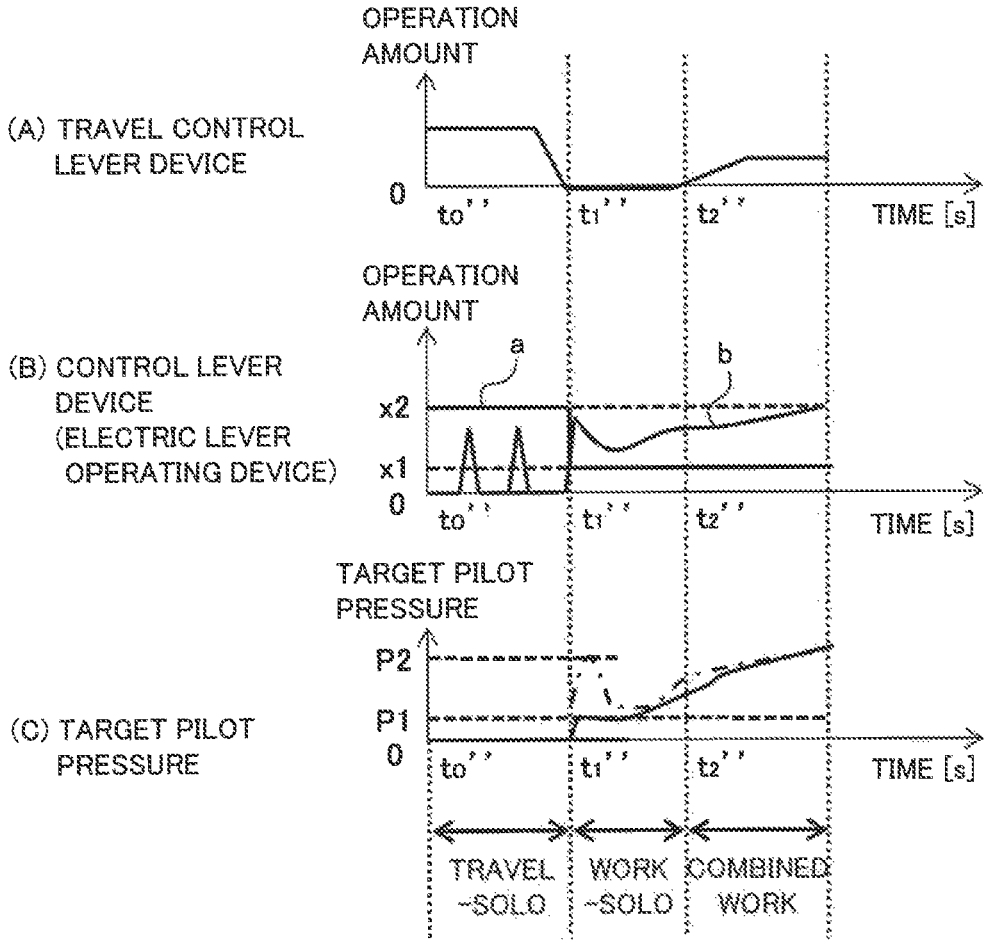
FIG. 16 is a characteristic diagram showing timeline behavior of the operation amount of each operating device and the target pilot pressure in the third embodiment of the control system for a construction machine according to the present invention.

Next, the operation in the third embodiment of the control system for a construction machine according to the present invention will be described below with reference to FIG. 16. FIG. 16 is a characteristic diagram showing timeline behavior of the operation amount of each operating device and the target pilot pressure in the third embodiment of the control system for a construction machine according to the present invention. In FIG. 16, the horizontal axis represents time. The vertical axis in FIG. 16(A) represents the operation amount signal of a travel control lever device, the vertical axis in FIG. 16(B) represents the operation amount signal of an electric lever operating device, and the vertical axis in FIG. 16(C) represents the target pilot pressure signal. In FIG. 16(B), the characteristic line "a" represents the dead zone that has been set, and the line segment "b" represents the operation amount signal from the control lever device. In FIG. 16(C), P1 represents the target pilot pressure limited and controlled for the predetermined time since the state transition as explained with reference to FIG. 15, P2 represents the target pilot pressure determined without considering the state transition, and the chain line represents the behavior of the target pilot pressure signal assumed in the first embodiment not equipped with the machine body state transition judgment part 113.

Between time $t_0$" and time $t_1$", the machine is in the travel-solo state. Between time $t_1$" and time $t_2$", the machine is in the work-solo state. After time $t_2$", the machine is in the state of the traveling work.

Between time $t_0$" and time $t_1$", the machine body state judgment part 110 judges that the machine is in the travel-solo state. Based on the signal from the machine body state judgment part 110, the dead zone calculation part 111 sets the dead zone for the operation signal from the electric lever operating device at the second predetermined value x2.

As shown in FIG. 16(B), between time $t_0$" and time $t_1$", the line segment "b" as the operation amount signal of the electric lever operating device exhibits two mountain-shaped behaviors with peak values over the predetermined value x1 and less than the predetermined value x2. This indicates an operation amount signal caused by oscillation of the machine body. In this case, no command signal is outputted from the target pilot pressure calculation part 112B since the dead zone has been set at the second predetermined value x2 as mentioned above. Accordingly, the target pilot pressure signal remains at zero as shown in FIG. 16(C).

As shown in FIG. 16(A), the operation amount signal of the travel control lever device starts decreasing immediately before the time $t_1$" and reaches zero at the time $t_1$". In this case, the line segment "b" in FIG. 16(B) as the operation amount signal of the electric lever operating device exceeds the first predetermined value x1 and rises to a level in the vicinity of the second predetermined value x2 due to oscillation of the machine body. In this case, the machine body state judgment part 110 judges that the machine is in the work-solo state. Based on the signal from the machine body state judgment part 110, the dead zone calculation part 111 sets the dead zone for the operation signal from the electric lever operating device at the first predetermined value x1.

Accordingly, the line segment "b" in FIG. 16(B) as the operation amount signal of the electric lever operating device exceeds the first predetermined value x1 as the decreased dead zone. Thus, in the case where the machine body state transition judgment part 113 is not employed, the target pilot pressure sharply rises to a level in the vicinity of P2 as indicated by the chain line in FIG. 16(C). This leads to malfunction of a hydraulic actuator unexpected to the operator.

In this embodiment, the machine body state transition judgment part 113 notifies the target pilot pressure calculation part 112B of the occurrence of the state transition at the time $t_1$". The target pilot pressure calculation part 112B limits and controls the target pilot pressure with respect to the lever operation amount so that the target pilot pressure is set at P1, lower than the target pilot pressure P2 determined without considering the state transition, for the predetermined time since the state transition. Accordingly, the target pilot pressure exhibits behavior like that indicated by the solid line in FIG. 16(C). Consequently, the malfunction of a hydraulic actuator unexpected to the operator can be prevented.

In FIG. 16(B), between time $t_1$" and time $t_2$", the line segment "b" as the operation amount signal of the electric lever operating device rises to the level in the vicinity of the second predetermined value x2, thereafter decreases slowly, and then increases. This indicates an operation amount signal caused by the operator's operation. The target pilot pressure indicated by the solid line in FIG. 16(C) is limited to P1 for the predetermined time and thereafter gradually increases according to the operation amount signal of the electric lever operating device shown in FIG. 16(B).

According to this embodiment, by employing the configuration described above, the output limitation of the signal of the electric lever operating device at times of the combined traveling-work state can be inhibited, and a sharp change in the target pilot pressure can be prevented also in regard to the state transitions of the machine body.

By the above-described third embodiment of the control system for a construction machine according to the present invention, effects similar to the aforementioned effects of the first embodiment can be obtained.

Further, by the above-described third embodiment of the control system for a construction machine according to the present invention, the output limitation of the signal of the electric lever operating device at times of the combined traveling-work state can be inhibited, and a sharp change in the target pilot pressure can be prevented also in regard to the state transitions of the machine body.

Incidentally, while an example using the output signal from the electric lever operating device has been explained as the judgment method for the machine body state judgment part 110 of the controllers 100, 100A and 100B in the description of the first through third embodiments of the present invention, the judgment method for the machine body state judgment part 110 is not limited to this example. For example, the machine body state judgment part 110 may also be configured to judge whether the machine is in the middle of work or not by using an ON/OFF signal from a dead man switch attached to the electric lever operating device.

The present invention is not restricted to the first through third embodiments described above but contains a variety of modifications. The above-described embodiments, which have been described in detail for clear and easy explanation of the present invention, are not necessarily limited to those including all the components described above. For example, it is possible to replace part of the configuration of an embodiment with a configuration in another embodiment or to add a configuration in an embodiment to a configuration in another embodiment. It is also possible to make an addition/deletion/replacement of a configuration in regard to part of the configuration of each embodiment.

DESCRIPTION OF REFERENCE CHARACTERS

1*a*: Right travel control lever device (travel control lever device)
1*b*: Left travel control lever device (travel control lever device)
1*c*: Right control lever device (electric lever operating device)
1*d*: Left control lever device (electric lever operating device)
1P: Acceleration sensor
2: Hydraulic pump device
3: Travel hydraulic motor
4: Swing hydraulic motor
10: Lower track structure
11: Upper swing structure
15: Boom cylinder
17: Arm cylinder
19: Bucket cylinder
21, 22, 23, 24, 25, 26, 27, 28: Direction control valve
29: Lock lever
30: Gate lock valve
43, 44, 45, 46, 47, 48, 49, 50, 51, 52, 53, 54: Solenoid proportional valve
20: Control valve
100: Controller
110: Machine body state judgment part
111: Dead zone calculation part
112: Target pilot pressure calculation part
113: Machine body state transition judgment part

The invention claimed is:

1. A control system for a construction machine, comprising:

a hydraulic pump;

a hydraulic actuator for a front work implement driven by hydraulic fluid delivered from the hydraulic pump;

a travel device that allows a machine body to travel;

a pilot hydraulic source;

a control valve that adjusts a flow rate and a direction of the hydraulic fluid supplied to the hydraulic actuator by controlling pilot pressure;

an electric lever operating device that outputs an electric signal for commanding an operating direction and an operating speed of the hydraulic actuator;

a travel control lever device for commanding an operating direction and an operating speed of the travel device;

a solenoid proportional valve that decompresses the hydraulic fluid supplied from the pilot hydraulic source; and a controller that receives the electric signal from the electric lever operating device and outputs a drive command to the solenoid proportional valve, wherein the controller includes:

a machine body state judgment part that receives a signal representing an operation amount of the travel control lever device and judges whether the machine body is in a work-solo state, a travel-solo state or a combined traveling-work state based on the electric signal from the electric lever operating device and the operation amount of the travel control lever device;

a dead zone calculation part that calculates a dead zone for the electric signal from the electric lever operating device based on the state of the machine body judged by the machine body state judgment part; and a target pilot pressure calculation part that receives a signal representing the dead zone calculated by the dead zone calculation part and the electric signal from the electric lever operating device, calculates a target pilot pressure according to the electric signal and the dead zone, and outputs the drive command to the solenoid proportional valve, wherein the dead zone calculation part sets the dead zone for the electric signal at a first predetermined value when the machine body is in the travel-solo state and sets the dead zone for the electric signal at a second predetermined value smaller than the first predetermined value when the machine body is in the combined traveling-work state.

2. The control system for a construction machine according to claim 1, wherein:

the controller further includes a machine body state transition judgment part that judges transition of the state of the machine body, and when the machine body state transition judgment part judges that transition from the travel-solo state to the combined traveling-work state has occurred, the target pilot pressure calculation part limits an output value of a signal of the target pilot pressure until a predetermined time elapses since the time of the transition.

3. The control system for a construction machine according to claim 2, wherein the predetermined time for which the target pilot pressure calculation part limits the output value of the signal of the target pilot pressure is set longer with the increase in oscillation of the electric lever operating device in the travel-solo state.

4. The control system for a construction machine according to claim 1, further comprising an acceleration sensor that detects acceleration occurring to the machine body, wherein the controller calculates an oscillation frequency and amplitude of the machine body from the acceleration of the machine body detected by the acceleration sensor and changes the dead zone based on the calculated oscillation frequency and amplitude.

* * * * *